US005084651A

United States Patent [19]

Farney

[11] Patent Number: 5,084,651

[45] Date of Patent: Jan. 28, 1992

[54] MICROWAVE TUBE WITH DIRECTIONAL COUPLING OF AN INPUT LOCKING SIGNAL

[76] Inventor: George K. Farney, 82 Herrick Rd., Boxford, Mass. 01921

[21] Appl. No.: 114,627

[22] Filed: Oct. 29, 1987

[51] Int. Cl.[5] ..... H01J 23/48

[52] U.S. Cl. ..... 315/39.51; 315/39.75; 315/39.77

[58] Field of Search ..... 315/39.51, 39.53, 39.69, 315/39.75, 39.77, 39, 39.3; 333/1.1, 99 MP, 227, 156; 330/43, 47, 48, 49; 331/91, 86

[56] References Cited

U.S. PATENT DOCUMENTS

| | | | |
|---|---|---|---|
| 2,414,085 | 1/1947 | Hartman | 315/39 |
| 2,435,984 | 2/1948 | Spencer | 315/39 |
| 2,462,137 | 2/1949 | Smith | 250/27.5 |
| 2,467,538 | 4/1949 | Shoupp | 250/27.5 |
| 2,504,329 | 4/1950 | Heising | 315/40 |
| 2,542,797 | 2/1951 | Cuccia | 332/54 |
| 2,748,280 | 5/1956 | Nelson et al. | 250/36 |
| 2,765,423 | 10/1956 | Crapuchettes | 315/39.75 |
| 2,777,954 | 1/1957 | White | 315/39.51 |
| 2,808,538 | 10/1957 | Cutler | 315/39.3 |
| 2,832,050 | 4/1958 | Stinchfield | 332/5 |
| 2,846,613 | 8/1958 | Pierce | 315/3.6 |
| 2,849,652 | 8/1958 | Steimel | 315/39.75 |
| 2,881,270 | 4/1959 | Brown | 179/179 |
| 2,928,986 | 3/1960 | Wilbur | 315/39 |
| 2,950,416 | 8/1960 | Brown | 315/39.75 |
| 3,121,820 | 2/1964 | Wilbur | 315/39.65 |
| 3,121,821 | 2/1964 | Yu | 315/39.69 |
| 3,121,822 | 2/1964 | Boyd | 315/39.69 |
| 3,176,188 | 3/1965 | Wilbur | 315/39.69 |
| 3,223,882 | 12/1965 | Thal, Jr. | 315/39.3 |
| 3,305,693 | 2/1967 | Hull | 315/39.69 |
| 3,411,034 | 11/1968 | Farney | 315/39.53 |
| 3,427,499 | 2/1969 | Farney | 315/39.77 |
| 3,437,875 | 4/1969 | Farney | 315/39.69 |
| 3,445,718 | 5/1969 | McDowell | 315/39.3 |
| 3,448,330 | 6/1969 | Farney | 330/43 |
| 3,521,115 | 7/1970 | McDowell | 315/3.5 |
| 3,646,388 | 2/1972 | Dudley et al. | 315/3.5 |
| 3,701,020 | 10/1972 | DeVito | 325/121 |
| 3,714,592 | 1/1973 | Jory | 328/233 |
| 3,882,411 | 5/1975 | Ashida et al. | 330/287 |
| 3,927,347 | 12/1975 | Farney | 315/39.55 |
| 3,967,155 | 6/1976 | Chavanat et al. | 315/39.55 |
| 4,365,185 | 12/1982 | Brady et al. | 315/39.51 X |
| 4,571,552 | 2/1986 | Brown | 330/47 |

FOREIGN PATENT DOCUMENTS

| | | |
|---|---|---|
| 1541022 | 5/1971 | Fed. Rep. of Germany . |
| 2171164 | 9/1973 | France . |
| 2336788 | 7/1977 | France . |
| 917681 | 2/1963 | United Kingdom . |
| 1080144 | 8/1967 | United Kingdom . |

*Primary Examiner*—Eugene R. LaRoche
*Assistant Examiner*—Seung Ham
*Attorney, Agent, or Firm*—Wolf, Greenfield & Sacks

[57] ABSTRACT

A microwave tube similar in structure to a magnetron includes an output port and a separate input port. The tube includes a cathode, a reentrant anode circuit and means for producing crossed electric and magnetic fields in an interaction space between the cathode and the anode circuit. The microwave tube can be used as an injection-locked or injection-primed oscillator or as an amplifier. An input signal coupling network substantially blocks transfer of internally-generated RF energy at the operating frequency in a reverse direction through the input port toward the input signal source. The input coupling network includes an anode loop coupled between two points of equal phase and magnitude in the standing wave which exists on the anode circuit, and an input loop positioned for inductive coupling of the input signal to the anode loop. The input signal can be coupled to the input loop with a coaxial transmission line, a ridge waveguide or a twin-wire transmission line. The microwave tube can utilize conventional vane type or bar type anode circuits or can utilize mixed line anode circuits having both forward wave and backward wave sections.

28 Claims, 9 Drawing Sheets

MICROWAVE TUBE WITH DIRECTIONAL COUPLING OF AN INPUT LOCKING SIGNAL

FIELD OF THE INVENTION

This invention relates to a microwave tube similar in structure to a magnetron oscillator and, more particularly, to a microwave tube having a reentrant anode circuit, an input port for directional coupling of an input signal and a separate output port. The microwave tube can be utilized as a locked oscillator wherein the input signal controls the starting phase or controls both the oscillator frequency and phase during operation. Alternatively, the microwave tube of the present invention can be utilized as an amplifier.

BACKGROUND OF THE INVENTION

Magnetron microwave tubes are most commonly used as high-power oscillators either in a pulsed or a continuous mode. In a number of applications such as, for example, phased array radar and coherent radar systems, it is necessary to maintain the oscillator output signal locked in phase and frequency to a reference signal. It is well known in the microwave tube art to inject a signal into a magnetron type device to influence its performance as an oscillator. It is also known that the magnetron can be used as a negative resistance in a reflection-type microwave amplifier.

In prior art systems, the input signal is coupled or injected into the output port of the magnetron by means of a microwave circulator. Since the magnetron is not a matched load for the transmission line, a portion of the input signal is reflected from the output port of the magnetron and the remainder is coupled into the tube. The purpose of the circulator is to isolate the injected signal source from reflected input power and from the power output of the magnetron device. The division of input signal between reflected signal power and the useful signal coupled into the tube depends upon the magnitude of the mismatch associated with the resonator circuit coupling.

Magnetron oscillators have been used with signal injection in two ways: to obtain magnetron injection priming or to obtain magnetron injection locking. In magnetron injection priming the input signal is used to influence the starting phase of the oscillator but has little control of the oscillator frequency and phase when it is operating at full power. A relatively low input power level can accomplish control of the magnetron starting phase. Injection priming has had limited application.

In magnetron injection locking, the power level of the input signal is typically much larger than for priming. When the signal coupled into the oscillator tube is sufficiently large and sufficiently close in frequency to the free-running frequency of the magnetron oscillator, both the oscillator frequency and phase have a fixed relationship to the input signal. Useful injection locking has been obtained only at significantly lower gain than for oscillator priming.

It is desirable to control the output of an injection-locked magnetron over a selected bandwidth. However, the fraction of the input power that is coupled into the tube decreases as the input signal departs from the resonant frequency of the oscillator anode circuit, thereby necessitating additional input power. The external Q of the loaded resonant circuit of the oscillator can be decreased in order to increase bandwidth. However, in this case the input power level required to maintain locking also increases. As a result, acceptable bandwidths for practical system applications have been obtained only at moderate gain, and devices such as crossed-field amplifiers have been more widely utilized in system applications.

In order to use magnetron devices as reflection amplifiers, the external Q of the composite, loaded resonant circuit is made much smaller than the internal Q of the oscillator in order to obtain adequate bandwidth. Reflection amplifier operation over bandwidths of one to three percent or more has been achieved. However, the gain and bandwidth combination available with a magnetron device used as a reflection amplifier has not been sufficient to find widespread use. Such devices do not compare favorably with existing crossed-field amplifiers.

In spite of the drawbacks of prior art signal injection techniques, magnetron-type devices offer many advantages over other crossed-field devices including a more noise free output, better phase tracking between input and output, ease of frequency scaling, uniform anode power dissipation, and reduced size, weight and manufacturing costs. Therefore, it has long been an object of research efforts to provide a magnetron-type device wherein the output frequency and phase are locked to an input signal and wherein high gain and wide bandwidth are simultaneously obtained.

It is a general object of the present invention to provide an improved microwave tube.

It is another object of the present invention to provide a microwave tube similar in structure to a magnetron having a directional input port for coupling an input signal into an anode circuit while blocking internally-generated power from passing through the input port.

It is a further object of the present invention to provide a microwave tube similar in structure to a magnetron having a directional input port and a separate output port.

It is still another object of the present invention to provide a microwave tube similar in structure to a magnetron wherein output frequency and phase are locked to the frequency and phase of an input signal at a relatively high level of gain and over a relatively wide bandwidth.

It is still another object of the present invention to provide a microwave tube similar in structure to a magnetron which can be utilized as an amplifier having relative high gain and wide bandwidth.

It is yet another object of the present invention to provide a microwave tube similar in structure to a magnetron having a high output power level.

It is a further object of the present invention to provide a microwave tube having relatively small size and weight and having relatively low manufacturing cost.

SUMMARY OF THE INVENTION

According to the present invention, these and other objects and advantages are achieved in a microwave tube comprising cathode means including a cathode for generating a stream of electrons, a vacuum envelope for maintaining a vacuum about the stream of electrons, a reentrant anode circuit for supporting electromagnetic fields in interactive relationship with the stream of electrons, the anode circuit having a periodic slow-wave structure, means for applying an electric field between the cathode means and the anode circuit, means for applying a magnetic field perpendicular to the electric field in the region of the stream of electrons, an output port for coupling electromagnetic wave energy from the anode circuit to a load, and an input port and input coupling means for directional coupling of an input signal through the input port to the anode circuit in a forward direction while substantially blocking the transfer of internally-generated electromagnetic wave energy at the desired operating frequency of the tube through the input port in a reverse direction.

The microwave tube of the present invention overcomes the disadvantages of prior art injection locked magnetrons by providing separate input and output ports and an input signal coupling network which substantially blocks the transfer of internally-generated RF energy at the desired operating frequency in a reverse direction through the input port toward the input signal source. The coupling from each port to the anode circuit is separately adjustable with relatively little interaction between them. The tube combines features of a crossed-field amplifier and an injection locked magnetron. The unidirectional amplification characteristic is similar to a crossed-field amplifier. However, electronic interaction within the tube occurs with a resonated standing wave on the anode circuit similar to that which occurs in a magnetron oscillator instead of with a growing, traveling wave as in a crossed-field amplifier. The microwave tube of the present invention is advantageously operated as a locked oscillator or as an amplifier and provides relatively high gain and broad bandwidth.

The input coupling means includes a conductive anode loop coupled between two points of equal phase and magnitude in the standing wave which exists on the anode circuit, a conductive input loop positioned for inductive coupling of the input signal to the anode loop, and a coaxial transmission line for coupling the input signal to the input loop. Since the anode loop is coupled to points of equal phase and magnitude on the anode circuit, the internally generated RF energy at the operating frequency does not induce a current on the anode loop and power is transferred from the tube through the input port only as a result of capacitive coupling between the anode loop and the input loop. The capacitive coupling is made relatively small by suitable configuration of the input coupling means.

According to another important aspect of the invention, the input signal can be coupled to the input loop using a ridge waveguide. This configuration provides flexibility in impedance matching and relatively high power handling capability at high frequencies. In addition, when a double ridge waveguide is used, the input coupling circuit can be made symmetrical so that capacitively coupled, reverse directed power from the tube is balanced and no power is coupled back to the source.

In a preferred embodiment, the anode circuit comprises an even number of segments defining resonant cavities between them in a symmetric configuration such that the tube is constrained to operate in the pi mode wherein the electric fields in adjacent resonant cavities are 180° out of phase. In this embodiment, at least one conductive anode loop is coupled between alternate anode circuit segments which are in phase and have the same RF voltage magnitude.

In another preferred embodiment, the anode circuit includes a first section having a first dispersion characteristic and a second section having a second dispersion characteristic, the first and second dispersion characteristics intersecting or nearly intersecting at the pi mode of operation. Preferably, the first section has a forward wave characteristic and the second section has a backward wave characteristic, the first and second sections of the anode circuit each comprising a plurality of vane type or bar type anode elements, and at least one conductive anode loop is coupled between anode circuit elements having the same operating phase and magnitude.

According to yet another aspect of the invention, the input coupling means can be utilized for coupling of internally-generated spurious signals and noise to an auxiliary load. A circulator can be used for coupling both the input signal generator and the auxiliary load to the input port or a separate coupling circuit can be provided for coupling of the auxialiary load. Since spurious signals are dissipated in the auxialiary load, the purity of output signals delivered by the microwave tube is improved.

BRIEF DESCRIPTION OF THE DRAWINGS

For a better understanding of the present invention together with other and further objects, advantages and capabilities thereof, reference is made to the accompanying drawings which are incorporated herein by reference and in which.

DESCRIPTION OF THE PRIOR ART

Figure 1:
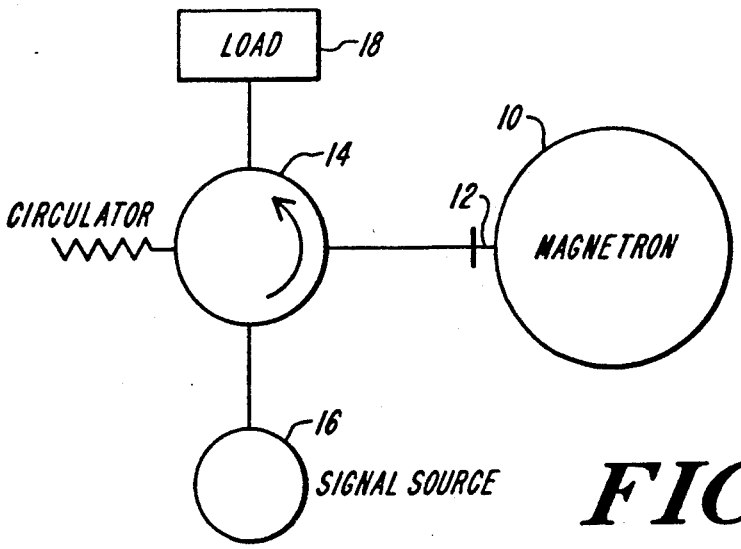
FIG. 1 is a block diagram of an injection locked magnetron in accordance with the prior art.

A prior art injection locked magnetron system is shown in FIG. 1. A magnetron 10 has its RF output port 12 coupled to one input port of a circulator 14, an injection signal source 16 is coupled to another input port of circulator 14 and a load 18 is coupled to an output port of circulator 14.

In operation, a locking signal is provided by source 16 through circulator 14 to the output port 12 of magnetron 10. A portion of the locking signal is coupled into the magnetron 10 and a portion is reflected. When the locking signal has sufficient amplitude and is sufficiently close in frequency to the natural resonant frequency of magnetron 10, then magnetron 10 oscillates at the same frequency and phase as the locking signal. The arrangement of FIG. 1 can also be used for injection priming of magnetron 10 during starting and for operation as an amplifier with respect to signal source 16. As noted previously, the arrangement of FIG. 1 is limited in gain and bandwidth and has not been widely used.

Figure 2A:
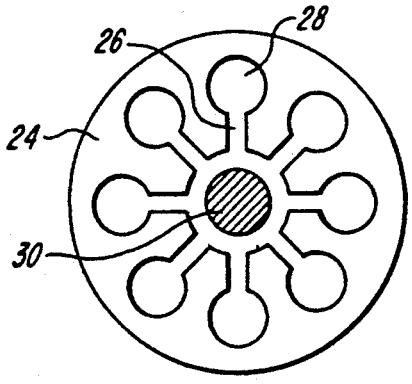
FIGS. 2A–2F illustrate vane type magnetron anode circuit configurations in accordance with the prior art.
Figure 2B:
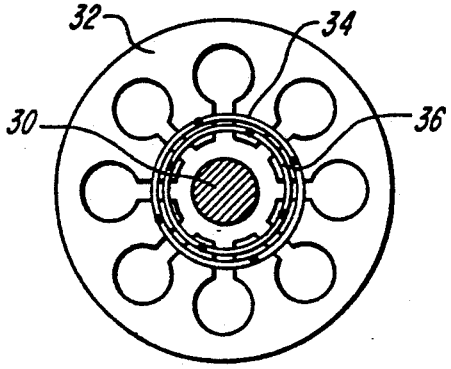
Figure 2C:
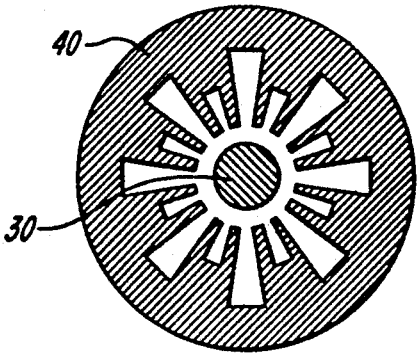
Figure 2D:
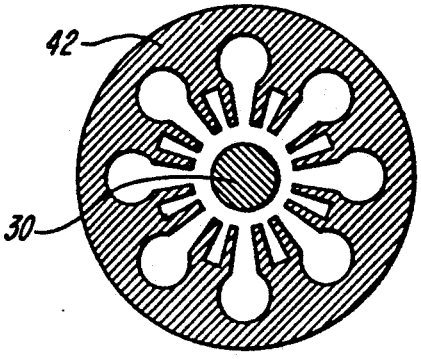
Figure 2E:
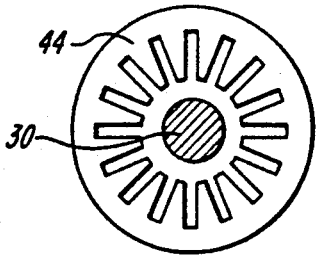
Figure 2F:
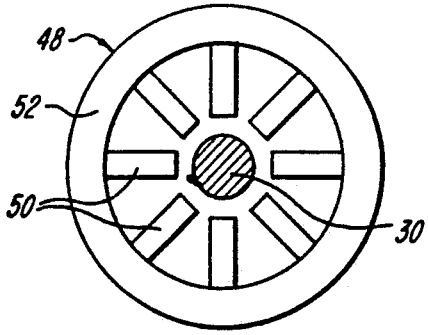

Magnetron oscillators are well known in the art and include as basic elements a cathode for emitting a stream of electrons, a vacuum envelope for maintaining a vacuum about the stream of electrons, an anode circuit disposed around the cathode, means for applying an electric field between the cathode and the anode circuit, and means for applying a magnetic field perpendicular to the electric field in the region of the stream of electrons. Examples of some prior art vane type anode circuit configurations are shown in FIGS. 2A–2F. Each anode circuit includes a plurality of radial segments which define between them resonant cavities. The anode circuit 24 shown in FIG. 2A includes slots 26 coupled to holes 28. The anode circuit 24 is symmetrical with respect to a centrally located cathode 30. A double-strapped slot and hole anode circuit 32 is illustrated in FIG. 2B. A first strap 34 couples alternate radial segments of the anode circuit 32 together and a second strap 36 couples the alternate pairs of radial segments not coupled by strap 34. The straps 34 and 36 force the tube into a pi mode of operation where adjacent segments of the anode circuit 32 are 180° out of phase. Rising sun type anode circuits 40 and 42 are illustrated in FIGS. 2C and 2D, respectively. The anode circuit 40 of FIG. 2C comprises alternating radial slots of different radial dimension. The circuit 42 in FIG. 2D includes radial slots alternating with slot and hole type resonators. An anode circuit 44 having a plurality of uniform radial slots is illustrated in FIG. 2E. An anode circuit 48 wherein radial vanes 50 extend from a backwall 52 is shown in FIG. 2F.

DETAILED DESCRIPTION OF THE INVENTION

Figure 3:
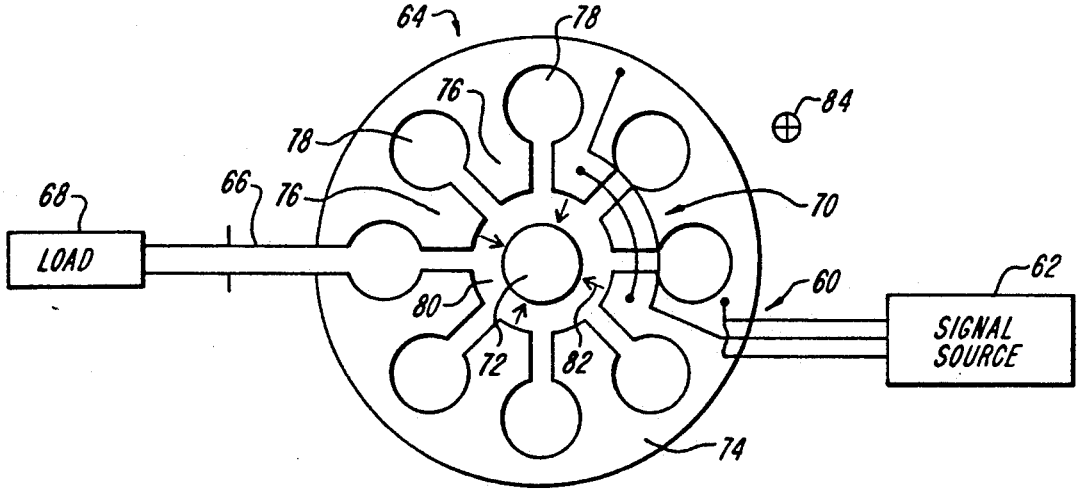
FIG. 3 schematically illustrates a microwave tube in accordance with the present invention.

A simplified diagram of a microwave tube in accordance with the present invention is shown in FIG. 3. The tube includes an input port 60 for coupling an input signal from a signal source 62 into the tube, a tube structure 64 as described in detail hereinafter and an output port 66 for coupling electromagnetic wave energy from the tube to a load 68. A directional input coupling circuit 70 permits the input signal to be coupled into the tube while blocking the transfer of internally-generated RF energy at the desired operating frequency in a reverse direction through input port 60. The input coupling circuit 70 is described in detail hereinafter.

The microwave tube of the present invention has been named a "PiMatron." It is a hybrid, crossed-field tube that combines features of a crossed-field amplifier and an injection locked magnetron. The basic device has an input port and an output port with a unidirectional amplification characteristic similar to a crossed-field amplifier. However, electronic interaction within the tube occurs with a resonated standing wave on the anode similar to that which occurs in a magnetron oscillator instead of with a growing, traveling wave on the anode that occurs in a crossed-field amplifier. The coupling from each port to the anode circuit is separately adjustable with relatively little interaction between them.

The tube structure 64 is similar to that of a magnetron oscillator. It includes a centrally located cathode 72 for generating a stream of electrons, a vacuum envelope (not shown) for maintaining a vacuum around the stream of electrons and a reentrant anode circuit 74 for supporting electromagnetic fields in interactive relationship with the stream of electrons. The anode circuit 74 is typically a periodic slow-wave structure having a plurality of radial segments 76 which define resonant cavities 78 between them. An annular interaction space 80 is defined between the anode circuit 74 and the cathode 72. A radial electric field 82 is applied in the interaction space 80 from a voltage source (not shown) connected between the cathode 72 and the anode circuit 74. A magnet (not shown) applies a magnetic field 84 perpendicular to the electric field 82 in the interaction space 80. Electromagnetic wave energy is coupled from the anode circuit 74 through output port 66. The anode circuit 74 is shown in FIG. 3 as having a slot and hole configuration. The anode circuit 74 can be replaced, in accordance with the present invention, with any of the anode circuits shown in FIGS. 2B–2F or with other well-known magnetron type anode circuits. The structural details of magnetron oscillators are well known to those skilled in the art.

Figure 4A:
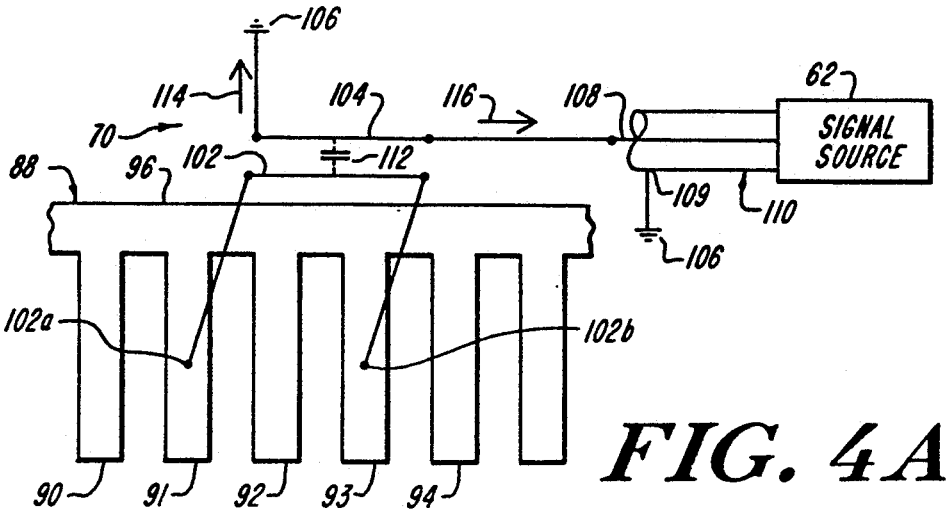
FIGS. 4A and 4B illustrate directional input signal coupling to the microwave tube of the present invention.
Figure 4B:
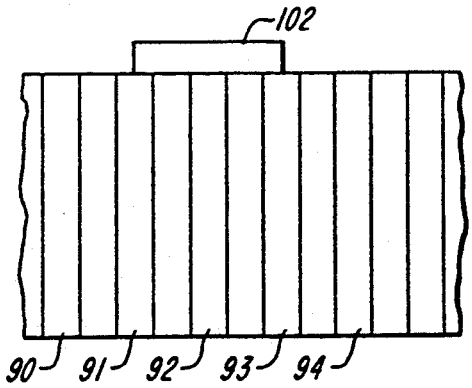

The directional input coupling circuit 70 is shown in schematic form in FIGS. 4A and 4B. A vane and slot type anode circuit 88 is shown in a fragmentary view which has been straightened to a linear configuration for ease of understanding. The anode circuit 88 includes a plurality of vanes 90–94 extending from a backwall 96.

Magnetron oscillators normally operate in the pi mode field pattern of the anode resonant circuit. In the pi mode there is 180° phase shift between the RF voltages across adjacent resonator gaps. This means that alternate vane elements of the anode circuit have voltages that are equal in magnitude and phase. This characteristic is used in strapped vane magnetron anode circuits as shown in FIG. 2B that have conductive straps connected between alternate vane elements to control the mode properties of the anode. When the magnetron oscillator is operating in the pi mode, there is no current flow between coupled vanes because equal voltages are applied to each end of the strap at the point of connection to the vanes.

Referring again to FIG. 4A, the directional input coupling circuit 70 includes a conductive anode loop 102 coupled between alternate anode circuit vanes 91 and 93 and positioned so that it does not contact the intermediate vane 92. The anode loop 102 can be coupled between any pair of vane elements in this kind of anode circuit which are separated by one intermediate vane element. A conductive input loop 104 is positioned adjacent to the anode loop 102 so as to permit inductive coupling between the anode loop 102 and the anode loop 104. Typically, the input loop 104 and the anode loop 102 run parallel to each other and are relatively closely-spaced to provide inductive coupling. One end of the input loop 104 is coupled to RF ground 106. In practice the backwall 96 of anode circuit 88 is RF ground, and the grounded end of input loop 104 can be connected to the backwall 96. The other end of the input loop 104 is connected to the center conductor 108 of a coaxial transmission line 110, and outer conductor 109 of transmission line 110 is coupled to RF ground 106. In practice, the input loop 104 is located between the anode loop 102 and the anode circuit backwall 96. Both loops 102, 104 are preferably arcuate in shape about a common center corresponding approximately to the central axis of the anode circuit.

In operation, an RF input signal supplied from signal source 62 through coaxial transmission line 110 causes an RF current to flow along center conductor 108 through input loop 104 to RF ground 106. The current then flows through RF ground at backwall 96 to the outer conductor 109 of coaxial transmission line 110 to complete the electrical circuit. RF electromagnetic coupling between input loop 104 and the anode loop 102 causes an RF voltage to be induced by the input signal between vanes 91 and 93. The amount of coupling between loops 102 and 104 is controlled by the geometry and relative position of the loops. The elements between the points of contact of the anode loop 102 present an RF impedance to the induced voltage. RF currents pass through this impedance and produce RF voltages across the openings between vanes 91 and 92 and between vanes 92 and 93.

As noted above, when a magnetron device is oscillating in the pi mode resonant frequency of the anode circuit, the voltages developed across adjacent resonators are 180° out of phase and alternate vane tips are identical in voltage magnitude and phase. Therefore, when the two ends of the anode loop 102 are coupled to alternate vane tips there is no voltage driving RF currents through the loop. With no RF current flowing in the anode loop 102, there is no RF inductive coupling to induce a voltage in the reverse direction into the input loop 104 and no inductively coupled power propagates back toward the source 62.

The input coupling circuit 70 has been described in connection with the pi mode of operation wherein the anode loop is connected between alternate vane tips. The same input coupling circuit can be applied to other anode circuit configurations which support a standing wave. In such cases, the anode loop is connected between two points on the anode circuit having equal phase and voltage magnitude so that no internally-generated current passes through the anode loop.

Although there is no inductive coupling of internally-generated RF energy at the operating frequency in the reverse direction through input coupling circuit 70, there is distributed capacitive coupling between the loops 102 and 104. The distributed capacitance can be represented by a single lumped element capacitance 112 shown in phantom in FIG. 4A. The anode loop 102 is driven by identical voltages at the vanes 91 and 93. Even though no current flows through loop 102, the voltage on anode loop 102 is capacitively coupled through capacitance 112. At the input loop 104, there are two parallel paths for RF energy coupled through capacitance 112 in the reverse direction. A first path 114 is through input loop 104 to RF ground 106, and a second parallel path 116 is through the input loop 104, back along the center conductor 108 of coaxial transmission line 110, through signal source 62 and back along the outer conductor 109 of transmission line 110 to RF ground 106. In both cases, the electrical circuit is completed to the anode vanes back along ground to the root of vanes 91 and 93 and then to points of contact **102*a* and 102*b* of the anode loop 102 to vanes 91 and 93, respectively. By appropriately tailoring the parameters of the input coupling circuit 70, the first parallel path 114 can be made to have a very low impedance relative to the second parallel path 116 so that nearly all the capacitively coupled RF power is shunted away from the second parallel path 116. As a result, the signal source 62** is effectively isolated from internally generated power.

Thus, the input coupling circuit 70 substantially blocks the transfer of internally-generated RF power at the operating frequency through the input port 60 to signal source 62. However, the input signal is effectively coupled by inductive coupling onto the anode circuit 88 during the entire time that internal RF power is being generated.

Figure 5A:
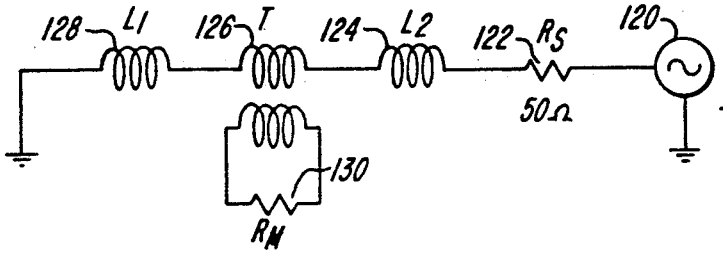
FIGS. 5A–5G illustrate equivalent circuit representations of the input coupling circuit in accordance with the present invention.
Figure 5B:
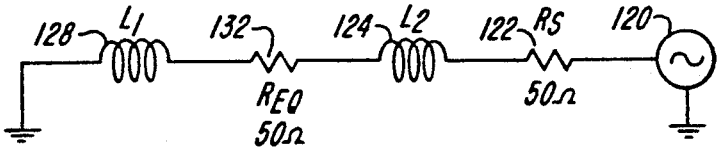

The functions of the input coupling circuit 10 can be better understood by consideration of lumped-element equivalent circuits. A lumped-element equivalent circuit shown in FIG. 5A includes an ideal signal source 120 and its internal impedance represented by a series resistance 122, an inductance 124 representing the self-inductance of the conductor between center conductor 108 of transmission line 110 and the input loop 104, an ideal transformer 126 representing the input loop 104 and anode loop 102 combination, and an inductance 128 representing the self-inductance of the conductor from the other end of the input loop 104 to RF ground 106 The equivalent resistive load impedance of the anode circuit at resonance together with the output load 68 transformed into the tube are represented by a resistance 130 connected as a load on the transformer 126. Coupling between the loops 102, 104 is adjusted to obtain optimum coupling so that maximum possible power is transferred from the signal source into the tube. In FIG. 5B, the transformer 126 representing the loops 102, 104 and the load impedance 130 have been replaced by an equivalent resistance 132 transformed to the primary side of transformer 126, and the self-inductance of transformer 126 has been absorbed into the values of inductances 124, 128. When the resistances 122 and 132 have equal values of, for example 50 ohms, and the net series inductive impedance of inductances 124 and 128 is relatively small compared to the net series resistances 122 and 132 combined, maximum power is transferred into the tube.

Figure 5C:
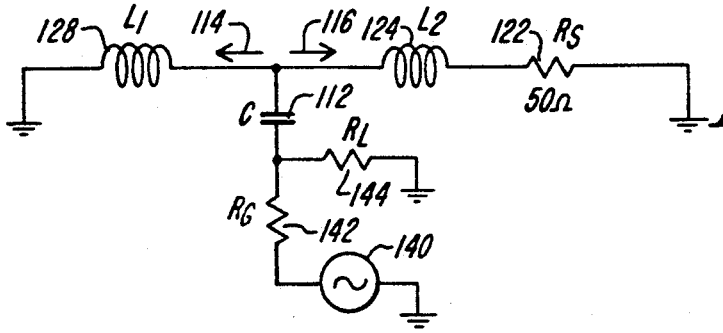

The equivalent load circuit for the tube when it is generating microwave power is shown in FIG. 5C. The internal generator of the tube is replaced by an ideal power generator 140 and an equivalent series resistance 142. The output load 68 is represented by a resistance 144. The input loop 104 and the anode loop 102 are replaced by the capacitance 112 which represents the distributed capacitance between the loops. Inductances 124 and 128 and resistance 122 represents the same elements as in FIGS. 5A and 5B. It is clear that there are significant differences between the equivalent load circuit presented to the signal source 120 as shown in FIG. 5B and the equivalent load circuit presented to the internal tube generator 140 as shown in FIG. 5C. By correctly tailoring the characteristics of the two circuits, maximum input signal coupling can be obtained while isolating the input signal source from the internal tube generator.

Figure 5D:
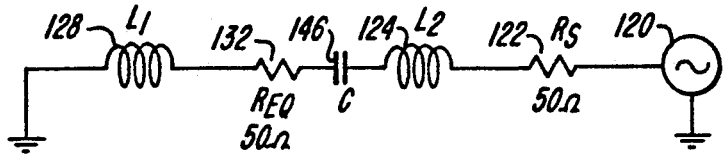

At relatively low frequencies, the inductive reactance of inductance 128 can be very small compared to the inductive reactance of inductance 124 and resistance 122 (50 ohms) in series. In that case, there is effectively a short circuit across the input to the signal source 120 as far as the internal generator 140 is concerned, and no internally-generated power is directed back to the signal source 120. However, the input impedance seen by signal source 120 is the net resistance of the loop together with the inductive reactances of inductances 124 and 128. It is preferable to make the loop circuit series resonant by the addition of a series capacitance 146 in the input path 116, as shown in FIG. 5D, having a capacitive reactance equal to the net inductive reactance of the loop. Maximum input power to the tube is obtained and the near short circuit impedance of inductance 128 prevents back-directed power flow to the generator 120.

Figure 5E:
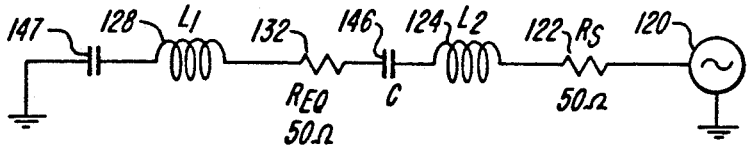

At practical operating frequencies, the reactive impedances of inductances 124 and 128 are not negligable and another approach must be used. One method is to add capacitance 146 as described above and to add in path 114 a capacitance 147 having a capacitive reactance equal to the inductive reactance of inductance 128, as shown in FIG. 5E. In this case, both paths 114 and 116 are series resonant and the injection source is isolated from back-directed power from the tube.

Figure 5F:
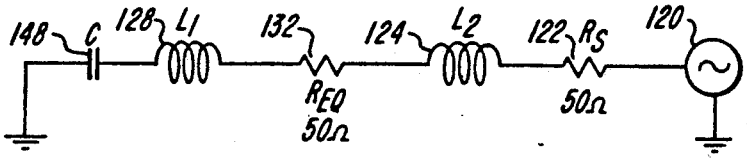

At high operating frequencies, the inductive reactances of inductances 124 and 128 both become relatively large. In that case, a capacitance 148 can be added in series between inductance 128 and RF ground in order to make the equivalent closed circuit for the input signal source 120 a series resonant loop as shown in FIG. 5F. The value of the inductive reactance of inductance 124 should be ten times or more larger than the equivalent series resistance 122. When the capacitive reactance of capacitance 148 is equal to the sum of the reactances of inductances 124 and 128, the series loop impedance is purely resistive and maximum power transfer occurs at critical coupling (or matched load) if the resistances 122 and 132 are equal.

Figure 5G:
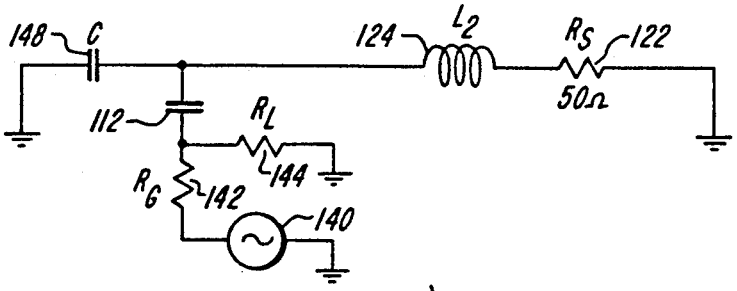

An equivalent load circuit for the tube when generating internal power for the circuit of FIG. 5F is shown in FIG. 5G. The path to RF ground has a large capacitive reactance nearly equal to the inductive reactance of inductance 124. The input loop appears as a parallel resonant circuit connected to the transfer capacitance 112. When the ratio of the inductive reactance of inductance 124 to the source resistance 122 is 10, it can be shown that there is a 13 db isolation of the input source 120 from power generated within the tube even though the source 120 delivers power into a matched load.

The input coupling circuit 70 described above provides directional properties for maximum input signal coupling and provides good isolation of the input signal source from the internal power generating source. The microwave tube shown in FIG. 3 and described hereinabove is a two port device which can be used for injection priming, injection locking or as an amplifier. In each case, there is a gain improvement in comparison with the prior art configuration shown in FIG. 1, since there is no mismatch loss at the RF input causing loss of input power due to reflection.

The near independence of the coupling adjustments for the input and output ports of the microwave tube of the present invention allows for the relative gain/bandwidth product of the tube to be tailored for best operation whether used as an injection primed or an injection-locked oscillator or as an amplifier. Since the tube has an input port and an output port, even the configurations commonly known as injection priming and injection locking can be regarded in the present invention as a form of amplifier. The major difference between the two configurations is the value of the loaded Q as seen from the output port. Very low values of loaded Q corresponding to wide bandwidth may not support oscillation or stable operation in the absence of an input signal. As an oscillator (injection primed or injection-locked), the tube will have more gain because of built-in regeneration due to resonance. Hence, the microwave tube of the invention has a gain/bandwidth product.

As noted above, most magnetron oscillators use anode circuits intended to oscillate in the resonant pi mode field pattern. Those most commonly used are the unstrapped anode comprising quarter wave resonators slots, single and double strapped anodes, rising sun anodes and the types used in coaxial and inverted coaxial magnetrons. All these anode circuits are well known in the art. The above-described configuration utilizing separate input and output ports and utilizing the novel input coupling circuit for coupling an input signal to the anode circuit can be used with any of these anode circuits or variations thereof, since the requisite voltages of identical magnitude and phase are found on alternate vane elements. Bar type anode circuits wherein a plurality of anode bar elements extend between top and bottom ground planes are also well known in the art. Bar type anode circuits are particularly useful in very high average power microwave tubes wherein coolant can be passed directly through hollow bar elements. The bar-type anode structure can be utilized in the microwave tube of the invention. In this case, the anode loop is coupled between bars having voltages of identical magnitude and phase during operation.

Figure 6A:
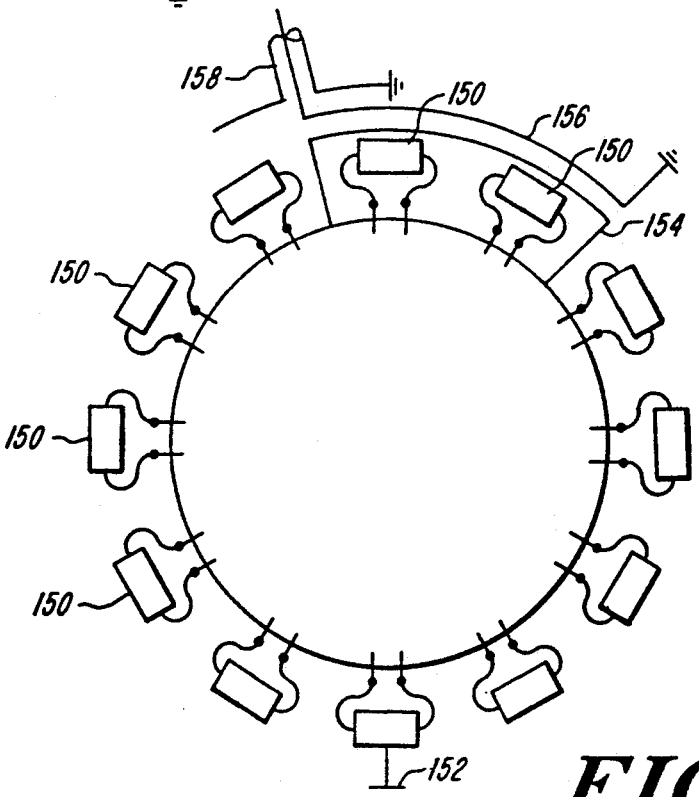
FIGS. 6A–6F illustrate various input signal coupling configurations in accordance with the present invention.

The unstrapped anode circuit used for pi mode oscillation in magnetrons includes an even number of identical quarter wave resonant slots. The unstrapped anode is used as an example in FIGS. 6A–6F to illustrate various configurations of the input coupling circuit. The equivalent circuit of a twelve resonator unstrapped anode is shown in FIG. 6A. Each slot resonator is replaced with an equivalent impedance 150 representing that resonator. The regions between impedances 150 represent resonator vane extensions from the back of the anode circuit. An RF output 152 is taken from one resonator section similar to what is done in many magnetron oscillators.

A single input coupling loop is illustrated in FIG. 6A. An anode loop 154 is coupled to two alternate vane elements and bridges two resonator gaps corresponding to two equivalent impedances 150. An input loop 156 is connected at one end to the center conductor of a coaxial transmission line 158. The other end of input loop 156 is connected to RF ground, and the outer conductor of the transmission line 158 is connected to RF ground. The loops 154 and 156 run generally parallel to each other and are closely spaced to provide inductive coupling as described above. The input signal coupled to the anode circuit develops a series voltage across the two bridge resonator sections. It will be understood that although the input signal is applied across one pair of resonators, there is a voltage applied across remaining resonators as a separate series circuit in parallel with the primary driven circuit. The input signal is distributed between all of the resonators. The anode loop 154 can be coupled across the resonator section where the RF output 152 is taken. Such a position is advantageous in minimizing the slow wave circuit phase length between the input and output ports for better phase stability due to differences in RF drive magnitude and due to changes in the voltages applied to the tube.

Figure 6B:
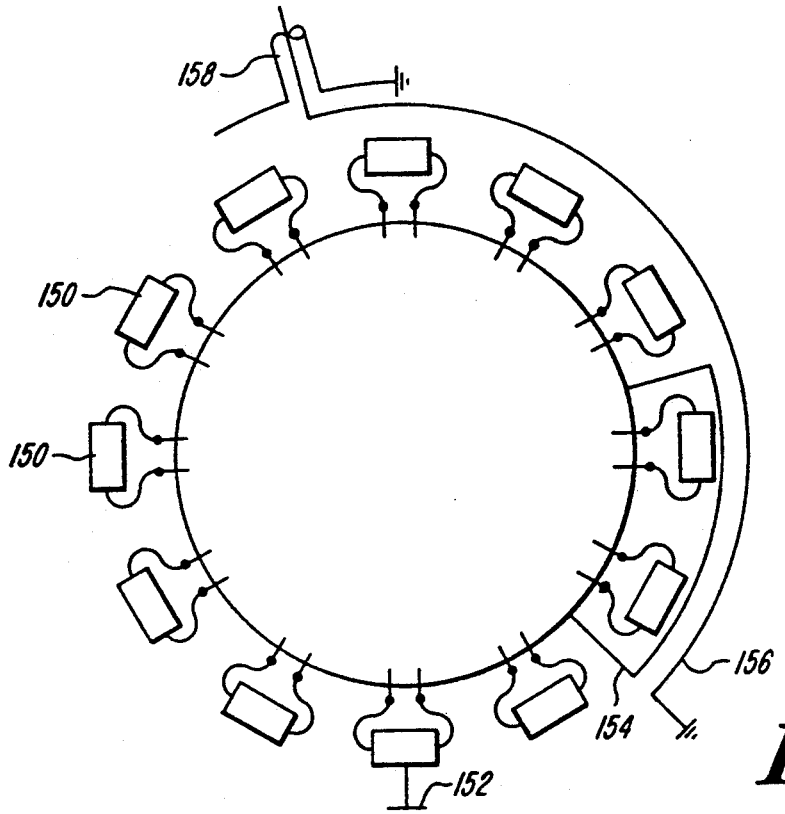

Another embodiment of the invention is shown in FIG. 6B. The anode loop 154 is located more remotely from the input transmission line 158. As a result, there is a longer conductor and greater impedance between the input loop 156 and the transmission line 158. The longer conductor provides additional inductance which can be used as described above to improve isolation between the internally-generated power and the signal source.

Figure 6C:
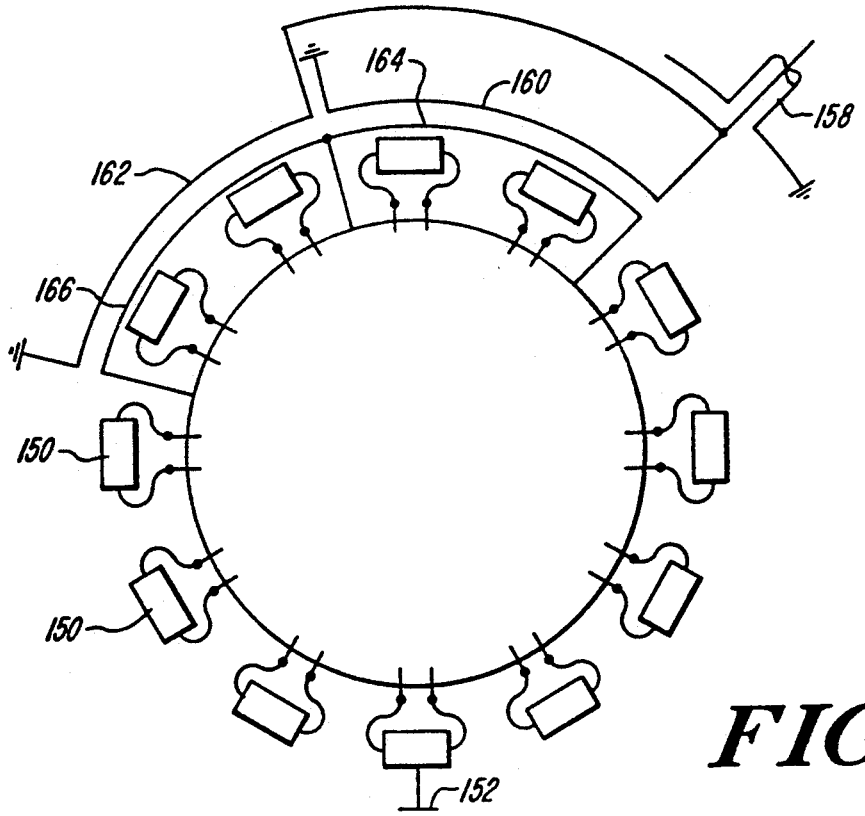
Figure 6D:
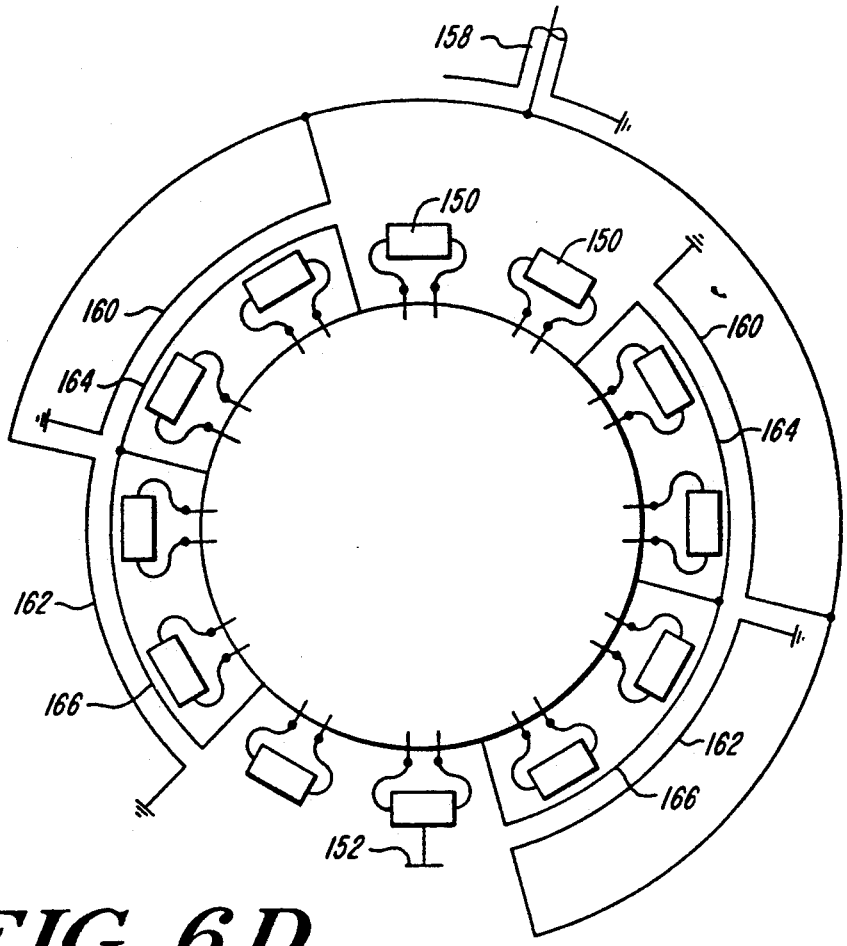
Figure 6E:
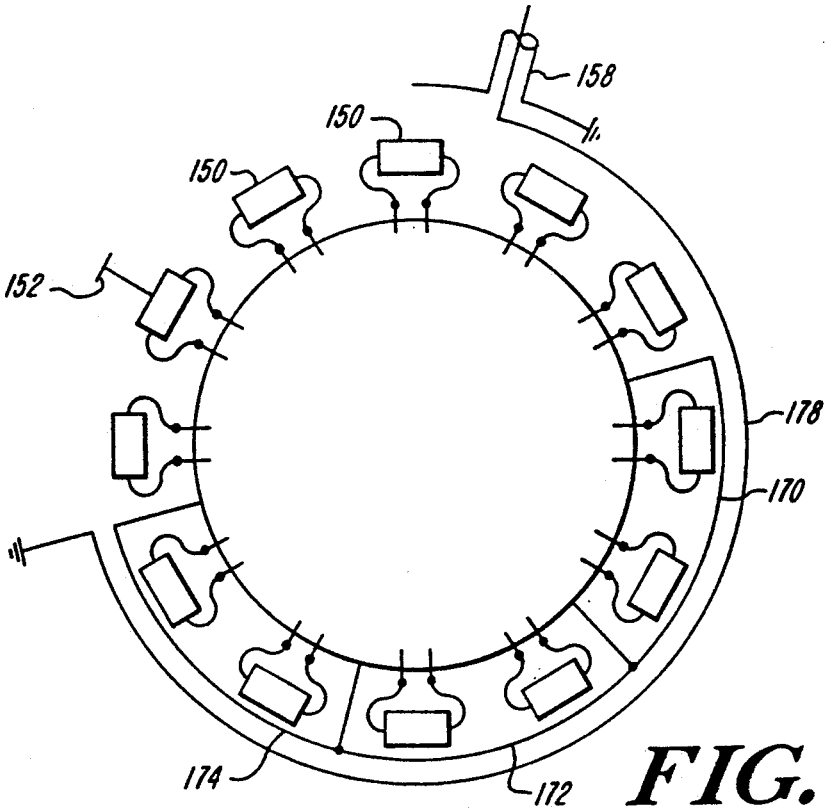
Figure 6F:
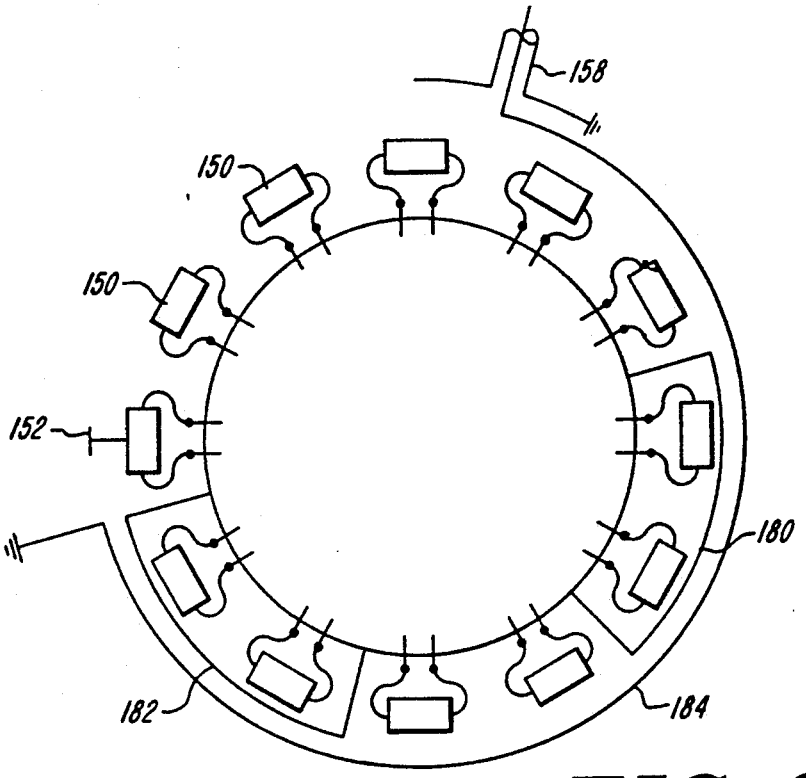

Another input coupling circuit configuration with two parallel input coupling loops 160 and 162 and two anode loops 164 and 166 is shown in FIG. 6C. The anode loops 164, 166 are connected to alternate vane elements so that the input signal is applied to four resonators in series. A circuit configuration utilizing two of the coupling networks shown in FIG. 6C is shown in FIG. 6D. This configuration provides more symmetrical excitation, particularly in an anode circuit including a large number of sections. It also assures that both the proper orientation of the RF electric fields across the resonator gaps and the relative phases of the gap voltages are preserved. A configuration with multiple connected anode loops 170, 172, 174 and a single input loop 178 is shown in FIG. 6E. Each anode loop 170, 172, 174 functions independently even though all are inductively driven by the single input loop 178. A configuration including two non-connected anode loops 180 and 182 inductively driven by a single extended input loop 184 is shown in FIG. 6F.

It will be understood by those skilled in the art that other input coupling circuits are included in the scope of the present invention. For example, the above described input coupling configurations and variations thereof can be used at one or both ends of the anode structure. In the case of strapped resonator systems, strap loops connect alternate vane elements. The strap loops can be used as anode coupling loops provided the strap loops are accessible for inductive coupling from an input loop. The input loop can use either or both of the single straps located at opposite ends of the anode circuit. In the case of double strapped anodes, the input loop is preferably coupled to the strap of larger diameter with the input loop located between the outer strap and the backwall of the tube.

The input coupling circuit of the present invention can also be utilized in coaxial magnetron anode circuits. The presence of the stabilizing cavities in coaxial magnetrons requires a special arrangement to couple the input signal to the anode circuit without interfering with oscillator performance. The coaxial transmission line for carrying the input signal can pass through the end spaces of the tube on either or both ends of the anode structure. An alternative technique is to pass a coaxial transmission line directly through the stabilizing resonant cavity in a radial direction so that it is perpendicular to all components of RF electric fields of the $TE_{011}$ cavity mode. For an inverted coaxial magnetron, the coaxial transmission line passes part way along the central axis of the stabilizing circular waveguide cavity where there is little RF stored energy. At the anode vane system, the coaxial transmission line is bent at a right angle and passes to the anode wall in a radial direction so that is always perpendicular to the RF electric field in the resonant cavity. The coaxial line passes through the backwall of the anode structure and is coupled to the vane system as described hereinabove.

Rising sun anode circuits are illustrated in FIGS. 2C and 2D. The name rising sun is used to refer to an anode geometry with a biperiodic system. In such anode circuits, alternate elements are alike but adjacent elements are different. The biperiodic system causes the natural resonant modes of the system to break into two groups, a low frequency group and a high frequency group. The resonant frequency at which the magnetron oscillates is intermediate to the natural resonant frequency of each of the two independent resonators. The input impedance across the input to two dissimilar resonators connected in series at a frequency between the two natural resonant frequencies is that of an inductive reactance and a capacitive reactance in series. Voltages developed across a series-connected inductive and capacitive reactance are 180° out of phase. With respect to the current flow, the 180° phase difference is exactly the same phase difference present between adjacent resonators of a magnetron oscillating in a true pi mode pattern. Therefore, an input coupling circuit of the present invention connected across two adjacent cells in a rising sun anode excites the anode at the input frequency and also establishes a pi mode field pattern for that frequency across the driven elements. When multiple anode loops are utilized as shown in FIGS. 6C–6F, the desired pi mode pattern can be established over a substantial portion of the anode circuit. As a result, the input signal exerts a large degree of control over the tube operation.

The impedance match from the coaxial transmission line through the input coupling circuit includes control of the input and anode loop parameters such as conductor size, length and separation. Another important parameter is the point on the anode circuit vane where the anode loop is connected. Impedance measured between the parallel sides of an ideal slotted resonator in an unstrapped anode varies in accordance with the tangent function from zero at the root end of the slot to a large value at the open end. A comparable impedance variation occurs along other anode geometries. Thus, the terminating impedance on the anode loop can be controlled by the point at which the anode loop is connected to the vanes.

The input matching can be illustrated with reference to an example Assume the tube of the invention is designed for X-band operation, and assume that the parallel region of inductive coupling between the input and the anode loops is 0.250 inch in length. The loop conductors are each 0.025 inch in diameter. The mutual inductance and the capacitance between the two wires were calculated at a frequency of $10^{10}$ Hertz utilizing well-known formulas. The mutual inductive reactance varies between a value of about 170 ohms for a separation of 25 mils and about 62 ohms for a separation of 150 mils. The capacitive reactance varies between a value of about 120 ohms for a separation of 50 mils and about 220 ohms for a separation of 150 mils.

Figure 7:
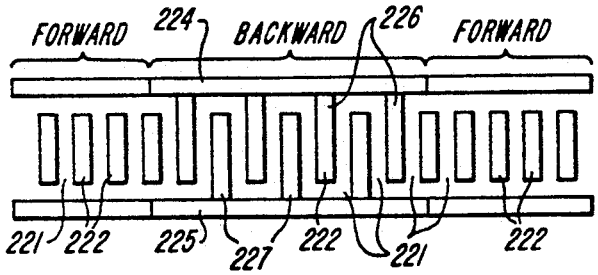
FIG. 7 illustrates an alternate embodiment of an anode circuit suitable for use in the microwave tube of the present invention.

The microwave tube of the present invention has been described thus far in connection with anode circuits having symmetry about the cathode. Another advantageous anode circuit configuration known in the prior art utilizes a so-called mixed line configuration to achieve pi mode operation with a relatively large separation between interfering modes. The mixed line configuration is described in U.S. Pat. No. 3,427,499 issued Feb. 11, 1969 to Farney and in U.S. Pat. No. 3,445,718 issued May 20, 1969 to McDowell, which are hereby incorporated by reference. A suitable strapped vane composite mixed line anode circuit is shown in FIG. 7. The circuit comprises an array of quarter wavelength vane elements 222 projecting outwardly from a conductive backwall and defining an array of slot resonators 221 in the spaces between adjacent vanes 222. The composite circuit includes a backward wave section and a forward wave section. The backward wave section includes a pair of straps 224 and 225 overlying the top and bottom edges of the vanes 222 near the end thereof. Adjacent vanes 222 are connected to the opposite strap of the pair of straps via conductive tab portions 226 and 227 to form a section of interdigital line. The forward wave section of the composite line circuit is formed by unstrapped sections of the vane resonator circuit. The circuit of FIG. 7 is shown in linearized form for the sake of clarity, and it is to be understood that the circuit typically surrounds a cathode in a reentrant configuration.

Figure 8:
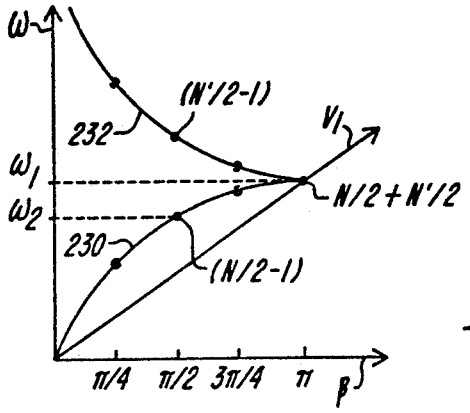
FIG. 8 is a graphic representation of the dispersion characteristic of the anode circuit of FIG. 7.

The dispersion characteristic for the mixed line anode circuit is shown in FIG. 8. The forward wave portion of the anode circuit has a dispersion characteristic as shown by curve 230 and the backward wave portion has a dispersion characteristic as shown by curve 232. When a partially-reflective impedance match is obtained between the backward and forward wave sections, the dispersion characteristic for the composite circuits is the two branches in combination. Each of the forward wave and backward wave sections has a number of resonant modes equal to the number of resonators in that section. For each section to have a pi mode, the number of resonators in each section must be an even number. Mode separation occurs because the number of resonators in each section is small compared to the total number of resonators in the anode circuit.

For the mixed line anode circuit shown in FIG. 7, possible modes of oscillation are indicated by the solid dots of the dispersion characteristic. When the two circuit sections are dimensioned to have a common pi mode operating frequency, the possible competing modes are widely separated from the pi mode. Thus, the mixed line anode circuit shown in FIG. 7 and characterized in FIG. 8 permits greatly enhanced mode separation. The enhanced mode separation is obtained for a greatly increased total number of slot resonators since the composite anode circuit may be broken up into many successive interaction circuits of alternating backward and forward wave type. The dispersion characteristic for such a structure remains as illustrated for the two section circuit shown in FIG. 8. Since the competing modes are more widely separated from the fundamental pi mode, a much greater operating bandwidth can be obtained in the microwave tube of the present invention without interference from competing modes. In order to provide a wide bandwidth amplifier, the two circuit sections can be designed with pi modes that are spaced apart in frequency. The composite response has a wider bandwidth than each individual section. When the mixed line anode circuit structure shown in FIG. 7 is used in the microwave tube of the present invention, broad band operation and high output power are obtained. A mixed line anode circuit utilizing a bar type anode structure, as disclosed in U.S. Pat. No. 3,445,718, can also be utilized in the microwave tube of the present invention.

In the above-described embodiments of the present invention, the input loop of the input coupling circuit is attached to the center conductor of a coaxial transmission line which serves as the RF input port to the microwave tube. According to another important aspect of the present invention, the input loop can be coupled to a single or double ridge waveguide, which couples the input loop to the input signal source. A double ridge waveguide 310 shown in FIG. 9A includes a rectangular waveguide 312 having ridges 314, 316 in the center of the long walls of waveguide 312. Ridge wavequides are well known in the art. An input coupling loop 320 is coupled to the tips 314*a* and 316*a* of ridges 314 and 316. An anode loop 322 is inductively coupled to input loop 320 and is coupled at ends 322*a* and 322*b* to points on the anode circuit having voltages of equal magnitude and phase as described hereinabove.

There are several advantages to using a ridge waveguide input line. Ridge waveguide dimensions can be designed for a wide range of output impedance values for the transition so as to facilitate impedance matching to the input coupling circuit and to the microwave tube and load. In addition, at high frequencies ridge waveguides can be designed to handle larger peak RF power levels than dominant mode coaxial transmission lines.

Figure 9A:
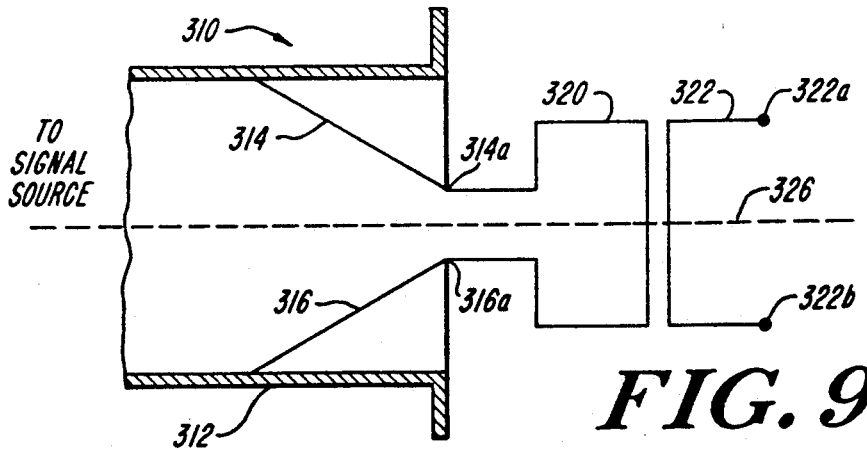
FIGS. 9A–9C illustrate other preferred input coupling techniques.

A particular advantage is associated with the configuration wherein the combination of double ridge waveguide 310, input loop 320 and anode loop 322 are symmetrical about a plane 326. The plane 326 of symmetry is the midplane between the ridges 314, 316 and passes through the center line of the input loop 320 and the anode loop 322. The current flow patterns through the input loop 320 and the anode loop 322 are similar to those described hereinabove. However, the two parallel paths excited by capacitive coupling between loops 322 and 320 and driven from the internal generator of the microwave tube are identical in this case. In the case of a coaxial transmission line, such symmetry does not exist. In the embodiment of FIG. 9A, the voltages at each of the waveguide ridges 314, 316 as a result of reverse-directed current flow from the microwave tube are identical in phase and magnitude. Consequently, the net driving voltage across the ridge waveguide 310 due to reverse-directed power is theoretically equal to zero, and no reverse-directed power is coupled into the ridge waveguide 310. In principle, the source isolation is infinite and provides perfect source protection.

Figure 9B:
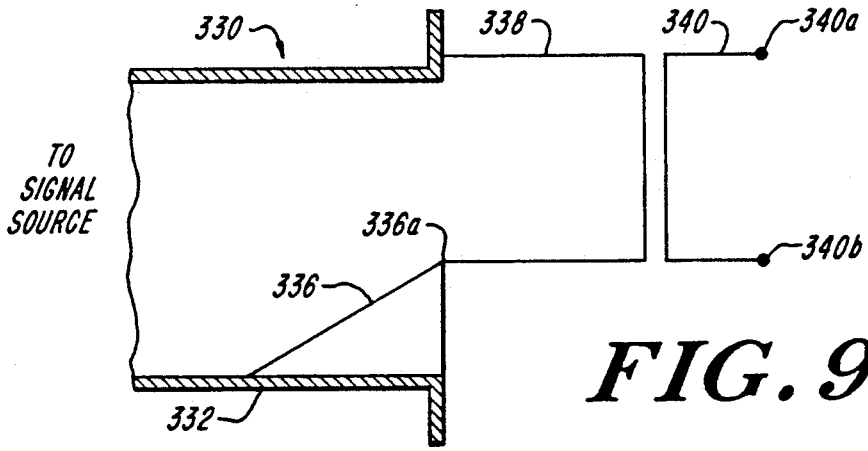

An embodiment utilizing a single ridge waveguide 330 is illustrated in FIG. 9B. A rectangular waveguide 332 has a single ridge 336 centered on one of its long walls. An input loop 338 is coupled between the tip 336*a* of ridge 336 and the opposite wall of the waveguide 332. An anode loop 340 is inductively coupled to input loop 338 and is coupled to the anode circuit at ends 340*a*, 340*b* as described hereinabove. The configuration of FIG. 9B has the advantages of better control over input impedance and high power capability. However, it lacks the symmetry of the configuration shown in FIG. 9A.

Figure 9C:
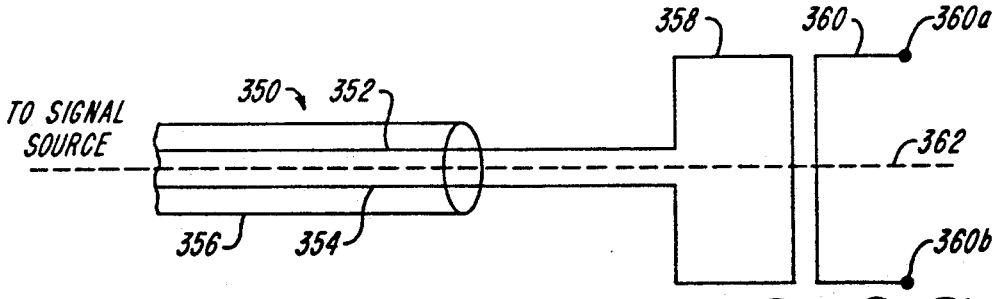

Another symmetrical configuration is illustrated at FIG. 9C. In this case, the input signal is coupled via a twin-wire transmission line 350 having signal conductors 352, 354 and a grounded shield 356. An input loop 358 is coupled to the signal conductors 352, 354, and an anode loop 360 is inductively coupled to input loop 358. The anode loop 360 is coupled to the anode circuit at ends 360*a*, 360*b* as described hereinabove. The configuration of FIG. 9C can be made symmetrical about a line 362, thereby eliminating reverse-directed power from reaching the input signal source as described hereinabove in connection with FIG. 9A.

Magnetrons can be operated in resonant modes in which the phase difference between adjacent resonators is not 180°. When non pi mode field patterns are established on a reentrant anode circuit, there is a standing wave pattern in which the peak voltage across each resonator is not the same. For a non pi mode field pattern, the standing wave field pattern can be symmetrical about one or more resonator. In this case, it is necessary to find anode resonator vane elements located symmetrically away from the point of the symmetry that have RF voltages of identical phase and magnitude during power generation. The anode loop can be attached between two such vane elements and the above-described operation of the input coupling circuit applies to such a case. One simple example is the so called zero mode wherein all the vane elements may have equal voltages.

A zero mode has all voltages in phase with each other but the voltages may not necessarily have the same magnitude. The rising sun resonant mode is a zero mode with all voltages in phase but the magnitude of the voltage on adjacent vanes may not be the same so the voltages are not truly identical. A slotted anode can be used in a space harmonic operation (two pi mode) of a zero mode of an upper passband, in which case all resonators have the same magnitude and phase. Hence, an anode coupling loop can be connected between any two vanes including adjacent vanes, as well as between vanes with any number (even or odd) of resonators in between.

The microwave tube of the present invention has been described in connection with anode structures having a standing wave pattern at the desired operating frequency. It will be understood that unwanted anode circuit modes, spurious modes and noise signals will not produce the same standing wave pattern as the desired output signal and will not have voltages of equal phase and magnitude at the points of connection of the anode loop. These internally-generated spurious signals will cause currents to flow in the anode loop and will cause electromagnetic power to be coupled back into the input coupling loop. The amount of coupled power depends on the magnitude of the excitation voltage and its frequency. Such power flows in a reverse direction toward the input signal source.

In accordance with another aspect of the present invention, the input coupling arrangement disclosed herein can be utilized to dissipate unwanted spurious signals, thereby preventing them from being delivered to the load coupled to the output port and improving the output signal to noise ratio of the microwave tube. One technique for dissipating unwanted spurious signals is illustrate in block diagram form in FIG. 10. A microwave tube 400 is constructed in accordance with any of the embodiments of the invention shown and described hereinabove. The microwave tube 400 has an output port 402 coupled to a load 404. An input signal source 406 is coupled to one port of a circulator 408. A second port of circulator 408 is coupled to an input port 410 of microwave tube 400. The input port 410 is coupled to an input coupling circuit as shown and described hereinabove. A third port of circulator 408 is coupled to an auxiliary load 412. With the arrangement shown in FIG. 10, the input signal from source 406 is coupled through circulator 408 to input port 410 and causes the microwave tube 400 to be locked to the input signal. Internally-generated spurious signals are coupled in a reverse direction through input port 410 and circulator 408 to load 412 where they are dissipated. It can be seen that spurious signal power dissipated in auxiliary load 412 reduces the spurious signal power delivered to the output load 404. The reverse-directed spurious power is much less than the full peak and average power output from the microwave tube 400, and the power handling capabilities of the circulator 408 and auxiliary load 412 are modest. While some of the spurious signal power is coupled to load 404, the diversion of some of the undesired output power through input port 410 to auxiliary load 412 is beneficial to the signal to noise (or other spurious and unwanted signal) ratio.

Figure 10:
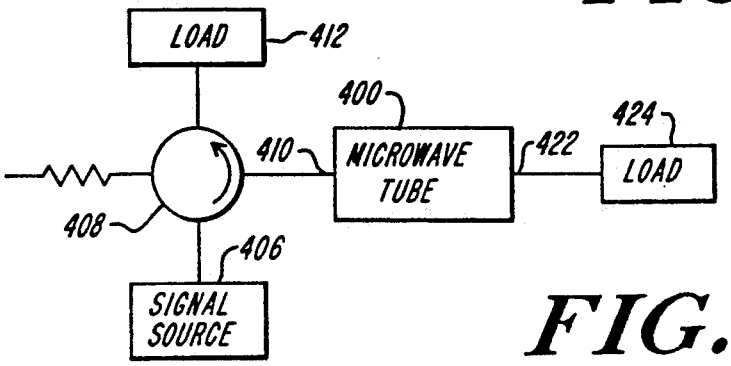
FIGS. 10–12 are schematic illustrations of techniques for utilizing the input coupling circuit of the present invention to dissipate spurious signals and noise.
Figure 11:
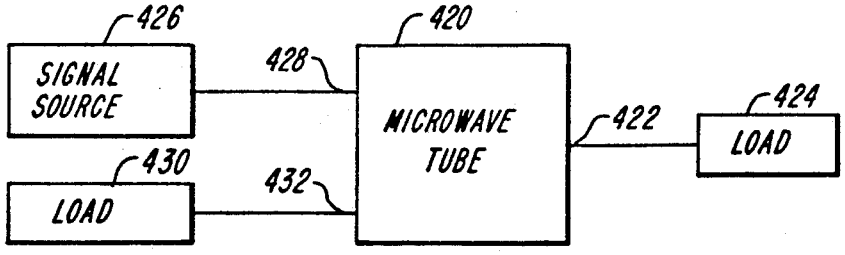

In the embodiment of FIG. 10, the geometry of the input coupling circuit is designed to function optimally with the input signal from source 406, and the diversion of spurious signal to the load 412 is not controlled. One or more additional input coupling circuits similar to the first can be added to the microwave tube without detriment to the desired operation, because the desired mode does not couple power back into the input coupling circuit. Such an arrangement is illustrated in FIG. 11. A microwave tube 420 has an output port 422 coupled to a load 424. A signal source 426 provides an input signal through a first input port 428. A load 430 is coupled to a second input port 432 of the microwave tube 420. Each of the input ports 428 and 432 is coupled to an input coupling circuit as shown and described hereinabove. The parameters of the input coupling circuits on the two input ports 428 and 432 are not necessarily the same. The coupling circuit for input port 428 is optimized for coupling the input signal into the tube 420, while the input coupling circuit at input port 432 is optimized for coupling unwanted spurious signals to the load 430.

In another alternative configuration, the arrangement shown in FIG. 10 can be utilized on either or both of the input ports 428, 432 of microwave tube 420. Two loads are provided for dissipating unwanted spurious signals and, when desired, two input signals can be coupled into the microwave tube 420. Each input arrangement can be optimized for input signal coupling or for reverse coupling of spurious signals.

Figure 12:
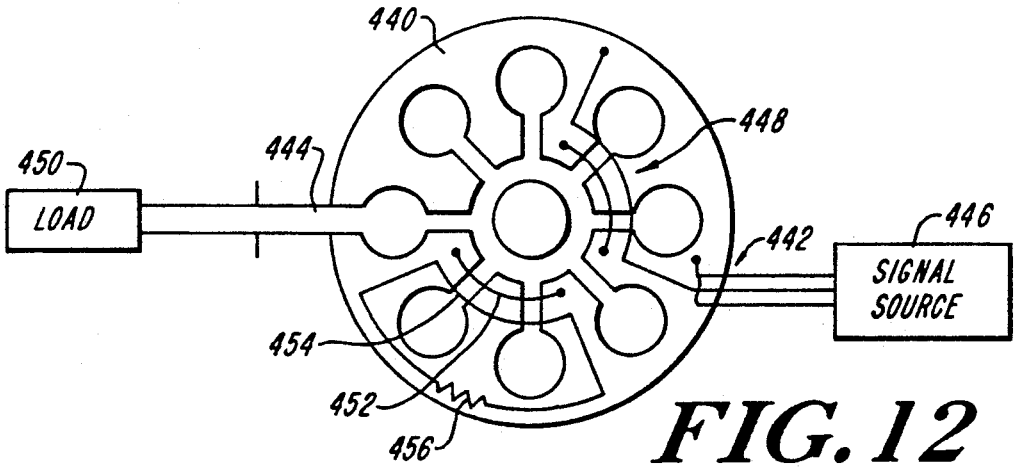

Yet another arrangement for dissipating unwanted spurious signals is illustrated in FIG. 12. A microwave tube in accordance with the present invention is constructed generally as described hereinabove and includes anode circuit 440, an input port 442 and an output port 444. An input signal generated by a signal source 446 is delivered through input port 442 to an input coupling circuit 448 as shown and described hereinabove, and output power from the tube is delivered through output port 444 to a load 450. In this embodiment, a coupling circuit and load are located internal to the vacuum envelope of the tube. An anode loop 452 is coupled between two points on the anode circuit 440 having voltages on the standing wave of equal magnitude and phase. An input or secondary loop 454, in this case not used for input coupling, is positioned for inductive coupling to anode loop 452, and a resistive load 456 is coupled to secondary loop 454. In this case, the inductive coupling between loops 452 and 454 is optimized and designed for heavily loading unwanted spurious signals on the anode circuit 440. The resistive load 456 is insulated from RF ground to prevent capacitively coupled signals from the desired signal mode (pi mode or other desired standing wave mode) from passing through the resistive load 456 to ground. In effect, the capacitive coupled circuit is open circuited, and no currents coupled from the desired mode flow in the loading circuit. Such resistive loading of unwanted spurious signal power can be made more dissipative than the output port and provide improved signal to noise ratio in the output signal. It will be understood that more than one loading arrangement of the type including loops 452, and load 456 can be provided in the microwave tube.

Figure 13:
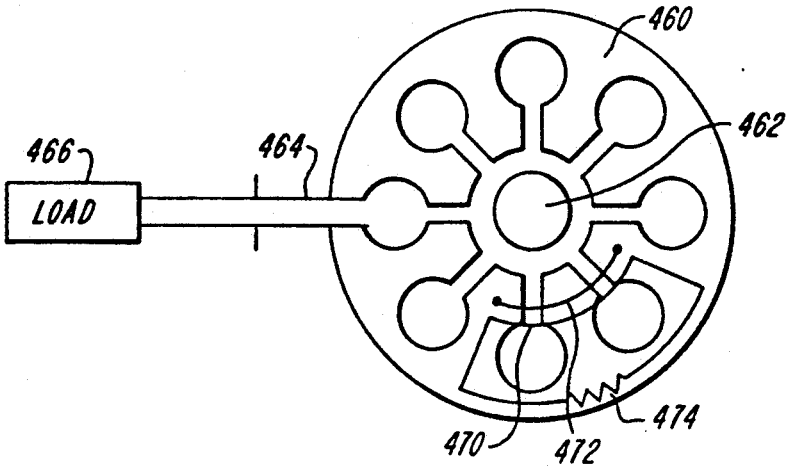
FIG. 13 is schematic illustration of a magnetron oscillator having a coupling network and load for dissipating spurious signals and noise.

The circuit for dissipating unwanted spurious power in the microwave tube of the present invention can be applied to conventional magnetron oscillators as shown in FIG. 13. A magnetron oscillator is shown schematically as including an anode circuit 460, a cathode 462 and an output port coupled to a load 466. The details of the magnetron construction have been omitted for simplicity since they are well known in the art. The anode circuit 460 has a standing wave during normal operation, and for the conventional pi mode magnetron alternate elements of the anode circuit 460 have voltages of equal phase and magnitude. An anode loop 470 is coupled between two alternate anode circuit elements, and a secondary loop 472 is positioned for inductive coupling from anode loop 470. A resistive load 474 is coupled to the ends of secondary loop 472. With this arrangement, signals at the desired mode of operation generate no voltages or currents in the anode loop 470 and are not coupled to resistive load 474. However, spurious signals generate currents in anode loop 470 and power is inductively coupled to secondary loop 472 and is dissipated in mode 474. As a result, the level of spurious unwanted signals in the magnetron output is reduced.

The input coupling circuit utilized in the microwave tube of the present invention has been described primarily in connection with crossed-field devices having reentrant anode circuits that have standing waves at the desired operating frequency. It will be understood that the input coupling techniques described herein can be applied in any circuit which is characterized by a standing wave. The input coupling circuit is utilized to couple an input signal to two points having voltages of equal magnitude and phase so that reverse directed power at the frequency of the standing wave is greatly reduced or eliminated entirely.

While there has been shown and described what is at present considered the preferred embodiments of the present invention, it will be obvious to those skilled in the art that various changes and modifications may be made therein without departing from the scope of the invention as defined by the appended claims.

I claim:

1. A microwave tube comprising:

cathode means including a cathode for generating a stream of electrons;

a vacuum envelope for maintaining a vacuum about said stream of electrons;

a reentrant anode circuit for supporting a standing wave electromagnetic field in interactive relationship with said stream of electrons, said anode circuit having a periodic slow wave structure;

means for applying an electric field between said cathode means and said anode circuit;

means for applying a magnetic field perpendicular to said electric field in the region of said stream of electrons:

an output port for coupling electromagnetic wave energy from said anode circuit to a load; and an input port separate from said output port and input coupling means for directional coupling of an input signal through the input port to said anode circuit in a forward direction while substantially blocking the transfer of internally-generated electromagnetic wave energy at the desired operating frequency of said microwave tube through said input port in a reverse direction.

2. A microwave tube as defined in claim 1 wherein said input coupling means comprises a conductive anode loop coupled between two points of equal phase and magnitude in the standing wave on said anode circuit, a conductive input loop positioned for inductive coupling of the input signal to said anode loop, and means for coupling the input signal to said input loop.

3. A microwave tube as defined in claim 1 wherein said anode circuit comprises a plurality of segments defining resonant cavities between them and wherein said input coupling means comprises a conductive anode loop coupled between segments of the same phase and magnitude in the standing wave, a conductive input loop positioned for inductive coupling of the input signal to said anode loop, and means for coupling the input signal to said input loop.

4. A microwave tube as defined in claim 1 wherein said anode circuit comprises an even number of segments defining cavities between them such that the tube is constrained to operate in the pi mode, wherein adjacent segments are 180° out of phase and wherein said input coupling means comprises at least one conductive anode loop coupled between alternate segments of the anode circuit, at least one conductive input loop positioned for inductive coupling of the input signal to said at least one anode loop, and means for coupling the input signal to said input loop.

5. A microwave tube as defined in claim 4 wherein said means for coupling the input signal to said input loop comprises a coaxial transmission line having a center conductor coupled to one end of said input loop and an outer conductor coupled to RF ground, and wherein the other end of said input loop is coupled to RF ground.

6. A microwave tube as defined in claim 4 wherein said at least one anode loop is coupled between alternate anode circuit segments at the end thereof.

7. A microwave tube as defined in claim 5 wherein said input coupling means further includes a capacitive reactance coupled in series with the center conductor of said coaxial transmission line.

8. A microwave tube as defined in claim 5 wherein said input coupling means further includes a capacitive reactance coupled between the other end of said input loop and RF ground.

9. A microwave tube as defined in claim 1 wherein said anode circuit comprises a structure having symmetry around the cathode.

10. A microwave tube as defined in claim 1 wherein said anode circuit includes a first section having a first dispersion characteristic and a second section having a second dispersion characteristic.

11. A microwave tube as defined in claim 10 wherein said first section has a forward wave characteristic and said second section has a backward wave characteristic.

12. A microwave tube as defined in claim 11 wherein said first and second sections each comprise a plurality of segments defining resonant cavities between them and wherein said input coupling means comprises at least one conductive anode loop coupled between segments having the same phase and magnitude in the standing wave, at least one conductive input loop positioned for inductive coupling of the input signal to said anode loop, and means for coupling the input signal to said input loop.

13. A microwave tube as defined in claim 2 wherein said means for coupling the input signal to said input loop comprises a ridge waveguide having at least one ridge coupled to said input loop.

14. A microwave tube as defined in claim 2 wherein said means for coupling the input signal to said input loop comprises a double ridge waveguide having ridges located on opposite walls thereof, said input loop being coupled at opposite ends to the two ridges.

15. A microwave tube as defined in claim 14 wherein said input loop and said anode loop are symmetrically located with respect to a center plane of said double ridge waveguide midway between said ridges.

16. A microwave tube as defined in claim 2 wherein said means for coupling the input signal to said input loop comprises a shielded two-wire transmission line, said input loop being coupled at opposite ends to the two wires of said transmission line.

17. A microwave tube as defined in claim 3 wherein the segments of said anode circuit comprise radial vanes.

18. A microwave tube as defined in claim 3 wherein the segments of said anode circuit comprise axial bars.

19. A microwave tube as defined in claim 11 wherein said first and second sections have pi modes of operation that are spaced apart in frequency to provide an increased composite bandwidth.

20. A microwave tube comprising:

a cathode for emitting electrons;

a reentrant anode circuit around the cathode and defining an annular interaction space between the anode circuit and the cathode, said anode circuit having a periodic, slow-wave structure for producing a standing wave electric field which interacts with said electrons, said anode circuit including a plurality of elements defining resonant cavities between them;

means for applying an electric field between said cathode and said anode circuit;

magnetic means for providing an axial magnetic field in said interaction space;

an envelope for maintaining a vacuum in said interaction space;

an output port for coupling internally-generated RF energy from said anode circuit to a load; and an input port separate from said output port and an input coupling circuit for directional coupling of an input signal to said anode circuit in a forward direction while substantially blocking the transfer of internally-generated RF energy at the desired operating frequency of said microwave tube through said input port in a reverse direction, said input coupling circuit including a conductive anode loop coupled between two points of equal phase and magnitude in the standing wave on said anode circuit, a conductive input loop inductively coupled to said anode loop and means for coupling the input signal to said input loop.

21. A microwave tube as defined in claim 20 further including a circulator having a first port coupled to said input loop, a second port for receiving said input signal and a third port coupled to an auxiliary load so that said input signal is coupled to said anode circuit and internally-generated spurious signals and noise are coupled through the input coupling circuit in the reverse direction to said auxiliary load.

22. A microwave tube as defined in claim 20 further including a second coupling circuit having a second anode loop coupled between two points of equal phase and magnitude in the standing wave on said anode circuit, a secondary loop inductively coupled to said second anode loop, and an auxiliary load coupled to said secondary loop so that internally-generated spurious signals and noise are coupled to said auxiliary load.

23. A microwave tube as defined in claim 22 further including a circulator having a first port coupled to said secondary loop, a second port for receiving a second input signal and a third port coupled to said auxiliary load.

24. A microwave tube as defined in claim 22 wherein said auxiliary load, said second anode loop and said secondary loop are located within said vacuum envelope.

25. A microwave tube comprising:

a magnetron tube including a reentrant anode circuit having a periodic slow-wave structure for supporting a standing wave electromagnetic field and further including an output port for coupling electromagnetic wave energy from said anode circuit to a load; and an input port separate from said output port and input coupling means for directional coupling of an input signal through the input port to said anode circuit in a forward direction while substantially blocking the transfer of internally-generated electromagnetic wave energy at the desired operating frequency of said microwave tube through said input port in a reverse direction, said input signal being coupled to said anode circuit so as to lock the operating phase and frequency of said oscillator to the phase and frequency of said input signal.

26. A microwave tube as defined in claim 25 wherein said input coupling means comprises a conductive anode loop coupled between two points of equal phase and magnitude in the standing wave on said anode circuit and means for inductive coupling of said input signal to said anode loop.

27. A microwave tube as defined in claim 25 wherein said anode circuit comprises an even number of segments defining cavities between them such that the tube is constrained to operate in the pi mode, wherein adjacent segments are 180° out of phase and wherein said input coupling means comprises at least one conductive anode loop coupled between alternate segments of the anode circuit, at least one conductive input loop positioned for inductive coupling of the locking signal to said at least one anode loop, and means for coupling the input signal to said input loop.

28. A method for locking the phase and frequency of a magnetron oscillator tube to an input signal comprising the steps of:

providing a magnetron oscillator tube including a reentrant anode circuit having a periodic slow-wave structure for supporting a standing wave electromagnetic field and further including an output port for coupling electromagnetic wave energy from said anode circuit;

providing a conductive anode loop coupled between two points of equal phase and magnitude in a standing wave on said anode circuit so that no currents are induced in said anode loop by internally-generated electromagnetic wave energy at the desired operating frequency of said magnetron oscillator; and inductively coupling an input signal to said anode loop.

* * * * *